US006530761B1

(12) United States Patent
Chalk et al.

(10) Patent No.: US 6,530,761 B1
(45) Date of Patent: Mar. 11, 2003

(54) DOUBLE-ACTING, TWO-STAGE PUMP

(75) Inventors: David Jonathan Chalk, Slatington, PA (US); Donald Earl Thompson, Schnecksville, PA (US); David John Farese, Riegelsville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/825,823

(22) Filed: Apr. 4, 2001

(51) Int. Cl.[7] ..... F04B 39/10; F04B 53/12

(52) U.S. Cl. ..... 417/552; 417/555.1; 62/50.6

(58) Field of Search ..... 417/552, 555.1, 417/549; 62/50.6; 60/456; 92/153, 154

(56) References Cited

U.S. PATENT DOCUMENTS

| | | | | |
|---|---|---|---|---|
| 3,145,629 A | * | 8/1964 | Gottzmann | 92/155 |
| 4,239,460 A | | 12/1980 | Golz | 417/251 |
| 4,334,833 A | * | 6/1982 | Gozzi | 417/258 |
| 4,345,880 A | * | 8/1982 | Zanarini | 417/264 |
| 4,396,354 A | | 8/1983 | Thompson et al. | |
| 4,396,362 A | | 8/1983 | Thompson et al. | |
| 4,447,195 A | | 5/1984 | Schuck | 417/570 |
| 4,559,786 A | | 12/1985 | Schuck | 62/55 |
| 4,576,557 A | | 3/1986 | Pevzner | |
| 4,639,197 A | * | 1/1987 | Tornare et al. | 417/529 |
| 4,792,289 A | * | 12/1988 | Nieratschker | 417/259 |
| 4,915,602 A | * | 4/1990 | Tschopp | 417/503 |
| 5,188,519 A | | 2/1993 | Spulgis | 417/511 |
| 5,511,955 A | | 4/1996 | Brown et al. | 417/259 |
| 5,575,626 A | * | 11/1996 | Brown et al. | 417/251 |
| 5,810,570 A | | 9/1998 | Nguyen | |
| 5,884,488 A | * | 3/1999 | Gram et al. | 62/50.6 |
| 6,015,270 A | * | 1/2000 | Roth | 417/259 |

FOREIGN PATENT DOCUMENTS

EP 0 743 451 B1 9/1998

* cited by examiner

*Primary Examiner*—Charles G. Freay
*Assistant Examiner*—Han L. Liu
(74) *Attorney, Agent, or Firm*—Willard Jones, II

(57) ABSTRACT

A reciprocating pump includes a housing, a piston slideably mounted within the housing for a reciprocating movement, a shaft connected to the piston and adapted for reciprocating movement concurrently with the piston, an inlet valve, a discharge valve, and an interstage valve means. A first chamber on one side of the piston is in fluid communication with an inlet and a second chamber on the opposite side of the piston is in fluid communication with a discharge, and the first and second chambers are in fluid communication. At least part of the shaft is in the second chamber. The interstage valve means, which controls the fluid flowing from the first chamber to the second chamber, is closed during a suction stroke and is open during a compression stroke.

15 Claims, 2 Drawing Sheets

DOUBLE-ACTING, TWO-STAGE PUMP

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The invention generally relates to mechanical pumps and more particularly to a pump that can be used to pump a fluid that may be a liquid, a gas, or a combination of both, and is particularly useful for pumping cryogenic fluids.

Cryogenic fluids, such as liquified hydrogen, oxygen, nitrogen, argon or liquified air, and liquified hydrocarbons, such as liquified methane, butane, propane or natural gas, are typically stored and transported in pressurized containers. The containers are typically well-insulated and refrigerated to very low temperatures. Pumps are used to transfer such fluids between containers or from one container to a point of use. While many types of pumps have been designed for these uses, mechanical pumps of the reciprocating type have been preferred for many applications.

Reciprocating pumps generally are required to have a net positive suction head (NPSH), i.e., a suction head above zero, to prevent the loss of prime of the pump and/or to prevent or reduce any tendency to cavitation within the pump. NPSH is the required additional pressure above the saturation vapor pressure of a liquid at any given temperature. Cavitation is the formation of vapor-filled cavities within the liquid caused in areas of the pump where the pressure of the moving liquid drops below the saturation vapor pressure. During compression the collapsing cavities may cause shock, vibration, noise, and erosion of metal surfaces, all of which can damage the pump.

The cryogenic pump disclosed in U.S. Pat. No. 5,188,519 (Splugis) includes a cylinder having a liquid inlet and a liquid outlet, and a piston reciprocally movable within the cylinder and generally intermediate the liquid inlet and the liquid outlet. The piston has a liquid flow conduit therethrough generally co-axial with the cylinder, the liquid flow conduit having an inlet end in liquid communication with the cylinder liquid inlet and an outlet end in liquid communication with the cylinder liquid outlet. A piston rod is attached to the piston for reciprocally moving the piston within the cylinder in a direction toward the cylinder liquid outlet. A valve operatively associated with and intermediate the piston rod and the piston liquid flow conduit inlet end alternately opens and closes the inlet to liquid flow, the valve being closed when the piston rod and piston are moved in the direction toward the cylinder liquid outlet and being open when the piston rod and piston are moved in the reciprocal direction.

The reciprocating cryogenic pump disclosed in U.S. Pat. No. 4,239,460 (Golz) is designed to operate with a very low NPSH. This pump uses a reciprocating piston which divides a cylindrical housing into a low pressure chamber and a smaller high pressure chamber. A gas inlet port extends through the side of the housing for channeling liquified gas into the low pressure chamber. A fixed piston extends from an outlet end of the housing into the high pressure chamber. The fixed piston slides within a cylindrical skirt carried by the reciprocating piston. Pressurized liquified gas is supplied to an outlet through a passageway within the fixed piston. One-way valves control the flow of liquified gas though the inlet, the several chambers and the outlet. During operation, the inlet fluid is compressed in the low pressure chamber in an effort to condense any gas that may come into the pump so that the resulting liquid can be forced into the high pressure chamber. If there is insufficient gas to be compressed, holes in the low pressure chamber allow excess liquid to return to a storage tank so that this chamber remains at relatively low pressure.

U.S. Pat. No. 4,447,195 (Schuck) and U.S. Pat. No. 4,559,786 (Schuck) disclose a two-stage pump, which essentially is made of two separate pumps connected by piping, having two chambers. Pumped fluid must pass through both chambers, having no intermediate way of returning to a storage tank. If the pumping results in unacceptably high pressure between the two stages of this two-stage pump, the excess pressure is vented by a relief valve.

U.S. Pat. No. 4,639,197 (Tomare, et al.) discloses a pump for cryogenic fluids that has two pistons connected by a common rod. The first piston is slightly larger in diameter than the second piston such that the second compression chamber is slightly small in volume than the first compression chamber. If there is excess liquid in the first stage of this two-stage pump, the excess liquid passes back to suction around the unsealed perimeter of the first stage piston.

U.S. Pat. No. 5,575,626 (Brown, et al.) discloses a two-stage cryogenic pump similar to the pump disclosed in U.S. Pat. No. 4,239,460 (Golz). The major difference is that this pump has an added feature, the capability to draw liquid from the bottom of a container, rather than being mounted external to a container.

U.S. Pat. No. 5,884,488 (Graham, et al.) discloses a single-stage pump intended to pump liquid only (not a two-stage pump designed for pumping two-phase fluids). Although this pump has two chambers, the second chamber within the pump is not intended to be a compression chamber. The volume of the second chamber is very large, such that the compression ratio is extremely slight. One embodiment of the pump has a first chamber and a second chamber communicating with the first chamber, a third chamber communicating with the second chamber, and a reciprocating piston separating the first, second, and third chambers from one another, and for drawing and compressing gas and liquid in any one of the chambers.

U.S. Pat. No. 5,511,955 (Brown, et al.) discloses a cryogenic pump which includes a reciprocating piston positioned in a first cylindrical housing for dividing the interior of the housing into a supercharger chamber and an evacuation chamber on opposite sides of the piston. At least one supercharger chamber inlet port extends through the cylindrical housing directly behind the reciprocating piston for channeling liquified gas from a liquified gas inlet into the supercharger chamber. A fixed piston is mounted in the housing and extends into the evacuation chamber. The fixed piston engages a skirt carried by the moveable piston to form a high pressure chamber between the movable and fixed pistons. A liquified gas outlet extends through the fixed piston from the high pressure chamber to the ultimate outlet.

There are various problems with the prior art pumps used to pump cryogenic liquids. For example, the prior art two-stage pumps do not necessarily allow all of the fluid pumped by the first stage to carry on through the pump to the discharge, the extra fluid having to be returned to a tank.

Also, some of the prior art pumps require either oversized motors to allow for extra power required during the compression stroke or large flywheels to store energy during the suction stroke.

It is desired to have a two-stage pump which operates as a single-stage pump when proper fluid conditions exist at the inlet, such that all of the fluid pumped passes through to the discharge.

It is further desired to have a two-stage pump within a single housing whereby the size and cost of the pump are relatively less than the size and cost of prior art pumps.

It is still further desired to have a two-stage pump that does not require a flywheel or oversized motor to store energy, but rather stores energy as pressure inside the pump during the suction stroke.

It also is desired to have an improved reciprocating pump for pumping cryogenic fluids which overcomes the difficulties and disadvantages of the prior art to provide better and more advantageous results.

BRIEF SUMMARY OF THE INVENTION

The present invention is a reciprocating pump for pumping at least one fluid that may be a liquid, a gas, or a combination of both. A first embodiment of the pump includes a housing, a piston slideably mounted within the housing for a reciprocating movement, a shaft connected to the piston and adapted for reciprocating movement concurrently with the piston, an inlet valve, a discharge valve, and an interstage valve means. The housing has a longitudinal axis, at least one inner wall, a first end, a second end opposite the first end, an inlet adjacent the first end, a discharge between the second end and the inlet, and an open interior between the at least one inner wall and the first and second ends. The piston is slideably mounted within the housing for a reciprocating movement substantially parallel with the longitudinal axis. The piston has a first cross-sectional area, a front end facing the first end, and a rear end opposite the front end, and divides the open interior into a first chamber having a first volume adjacent the inlet and a second chamber having a second volume adjacent the discharge. The first and second volumes vary inversely with the reciprocating movement of the piston. The first chamber is in controllable fluid communication with the inlet, the second chamber is in controllable fluid communication with the discharge, and the first and second chambers are in controllable fluid communication. The shaft, which has a forward end connected to the rear end of the piston and a rearward end opposite the forward end, is adapted for the reciprocating movement concurrently with the piston, and at least part of the shaft is disposed in the second chamber. The inlet valve is in communication with the inlet and is adapted to control the fluid flowing through the inlet to the first chamber. The discharge valve is in communication with the discharge and is adapted to control the fluid flowing from the second chamber through the discharge. The interstage valve means is in communication with the first chamber and the second chamber, and is adapted to control the fluid flowing from the first chamber to the second chamber. The interstage valve means is closed during a suction stroke and is open during a compression stroke, the suction stroke and the compression stroke occurring in an alternating manner during the reciprocating movement of the piston.

Various types of fluid may be pumped by the reciprocating pump, including but not limited to cryogenic fluids. In one variation, at least a portion of the fluid is a single phase fluid. In another variation, at least a portion of the fluid is a two-phase fluid.

In a preferred embodiment, the piston is moveable relative to the housing and the housing has a fixed position. In another embodiment, the piston has a fixed position and the housing is moveable relative to the piston.

In the preferred embodiment, the part of the shaft disposed in the second chamber has a second cross-sectional area substantially equal to about one-half the first cross-sectional area.

In another embodiment, the pump includes sealing means adapted to provide at least one seal between the inner wall of the housing and an outer surface of the piston in an alternating manner during the reciprocating movement. Preferably, the seal is provided during the suction stroke. The preferred sealing means includes at least one piston ring mounted peripherally on the piston.

In the preferred embodiment, at least part of the interstage valve means is mounted on the piston. However, other variations are possible. In one variation, the interstage valve means includes an inlet port in the inner wall adjacent the first chamber, a discharge port in the inner wall adjacent the second chamber, and transfer means adapted to transfer at least part of the fluid from the inlet port to the discharge port, the inlet port being in fluid communication with the first chamber and the discharge port being in fluid communication with the second chamber.

In addition, there are other embodiments of the invention, a reciprocating pump for pumping at least one fluid. One such embodiment includes a housing, a piston slideably mounted within the housing for a reciprocating movement, a shaft connected to the piston and adapted for a reciprocating movement concurrently with the piston, means for controlling the fluid through the inlet to the first chamber, means for controlling the fluid flowing from the second chamber through the discharge, and control means for controlling the fluid flowing from the first chamber to the second chamber, wherein the control means is closed during a suction stroke and is open during a compression stroke, the suction stroke and the compression stroke occurring in an alternating manner during the reciprocating movement of the piston. In this embodiment, the housing, the piston, and the shaft are all substantially the same as or similar to the housing, the piston, and the shaft of the first embodiment described above.

This alternate embodiment also may be used to pump various types of fluids, including but not limited to cryogenic fluids. In one variation of this embodiment, the part of the shaft disposed in the second chamber has a second cross-sectional area substantially equal to about one-half of the first cross-sectional area.

BRIEF DESCRIPTION OF THE DRAWINGS

The invention will be described by way of example with reference to the accompanying drawings, in which.

DETAILED DESCRIPTION OF THE INVENTION

The invention is a two-stage pump that is particularly useful for pumping cryogenic fluids. However, the pump also may be used with other types of fluids that may be liquids, gases, or combinations of liquid and gas. The pump is capable of pumping two-phase fluids as well as single phase fluids. It has many uses, including but not limited to use in the system and method discussed in a patent application being filed concurrently with this application and which is entitled "Pumping System and Method for Pumping Fluids" (Air Products and Chemicals, Inc.'s Ser. No. 09/825,784), which patent application is incorporated herein by reference.

Figure 1:
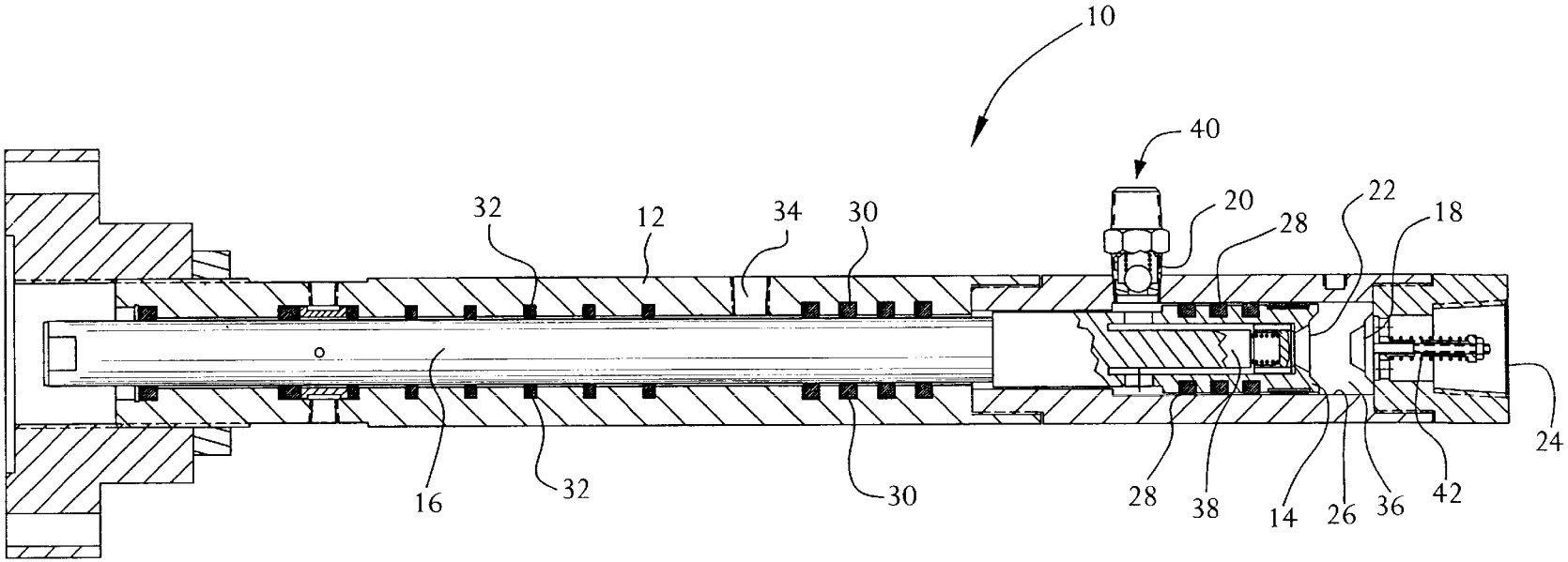
FIG. 1 is a partial cross-sectional view of the present invention.
Figure 2:
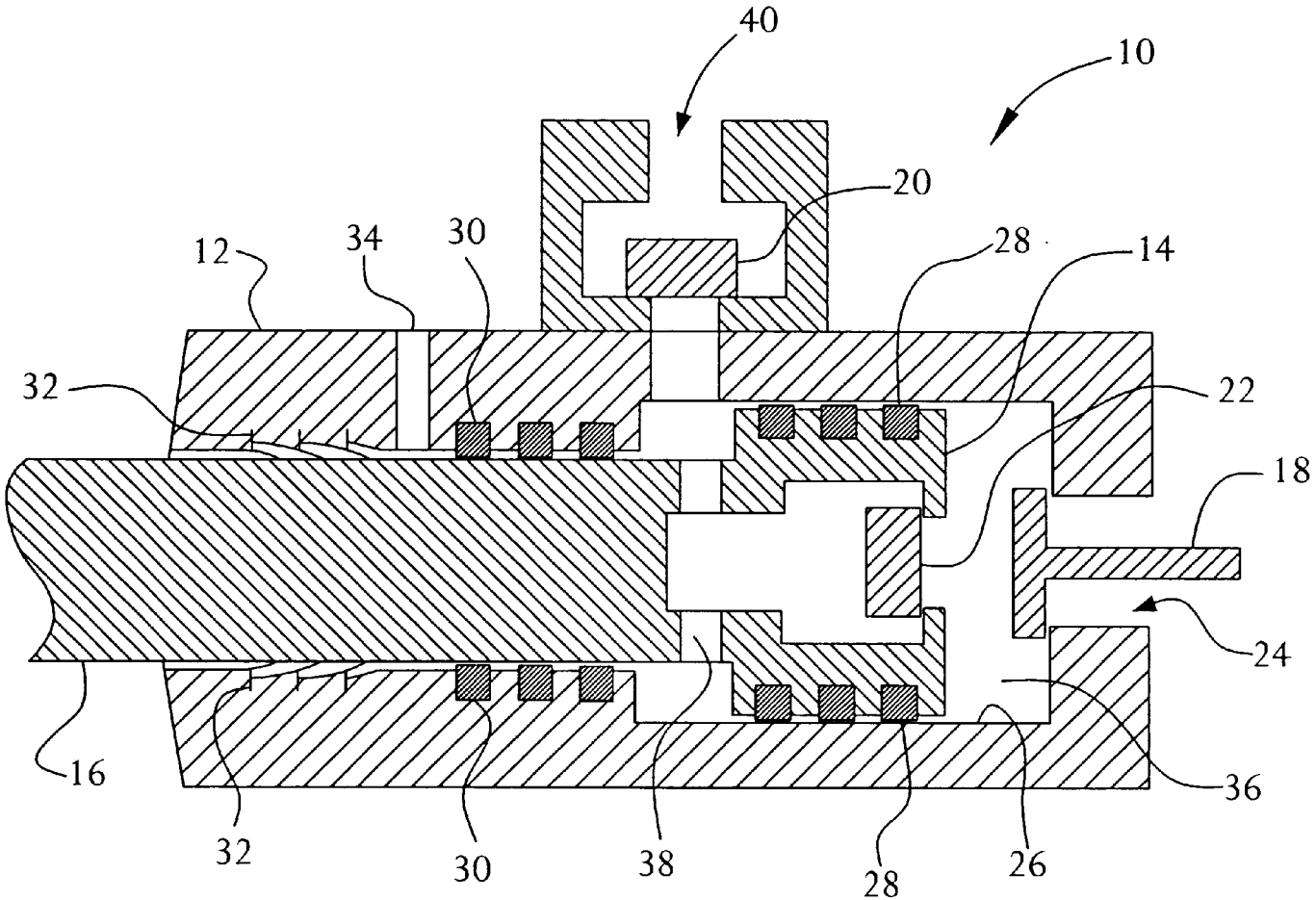
FIG. 2 is a schematic representation illustrating the pump of the present invention.

FIG. 1 shows a specific arrangement of one embodiment of the pump. FIG. 2 shows a simplified version of the pump to aid in understanding the operation of the pump.

Referring to FIGS. 1 and 2, the reciprocating pump 10 includes a housing 12, a reciprocating piston 14 within the housing, a shaft 16 connected to the reciprocating piston, an inlet valve 18, a discharge valve 20, and an interstage valve 22. Fluid enters the inlet 24 of the pump at a lower pressure and leaves the discharge 40 of the pump at a higher pressure. Sealing means between the inner walls 26 of the housing and the outer surface of the piston is provided by piston rings 28 mounted on the piston. Sealing means between the inner walls of the housing and the outer surface of the shaft includes high pressure shaft seals 30 and low pressure shaft seals 32. An outlet 34 in the housing adjacent the shaft 16 provides a means for vapor return to a storage tank (not shown) for the cryogenic fluid. In the preferred embodiment, the housing is cylindrical. However, persons skilled in the art will recognize that the housing may have other shapes.

The inlet valve 18, similar to a one-way check valve, allows fluid into the first-stage compression chamber 36 (or first stage or first chamber) as the piston 14 moves back to the left in FIGS. 1 and 2. At the same time, fluid is expelled from the second-stage compression chamber 38 (or second stage or second chamber) through the discharge valve 20, which also is similar to a one-way check valve. The interstage valve 22 is closed during the suction stroke. As the piston begins the compression stroke, moving to the right in FIGS. 1 and 2, the inlet valve closes, and the interstage valve opens. Fluid then passes through the center of the piston into the second stage of the pump. Depending on the compressibility of the fluid and system pressures, the fluid also may be expelled from the discharge valve. Since the volume of the second stage is less than the volume of the first stage, an incompressible fluid will pass through the pump and out the discharge 40. If the fluid is compressible, the fluid will be compressed to a higher density dependant on system pressures and fluid conditions.

In the preferred embodiment, spring-loaded valves are used for the inlet valve 18, interstage valve 22, and discharge valve 20, as shown in FIG. 2. (See for example, spring 42 of inlet valve 18 in FIG. 1.) However, persons skilled in the art will recognize that other types of valves may be used, such as valves having other types of biasing means and/or operating means.

The structure and operation of the piston rings 28 are discussed in greater detail in a patent application being filed concurrently with this application and which is entitled "Directional, Low-Leakage Seal Assembly" (Air Products and Chemicals, Inc.'s docket number 06116USA), which is incorporated herein by reference.

Heat is developed by the piston rings 28 due to friction. The amount of heat generated is significant, and can affect performance of the pump 10 if this heat enters the fluid prior to being pumped. Heat is generated when the piston rings are forced against the inner walls 26 when there is a high differential pressure across the piston rings, and the frictional loads are high. For this two-stage pump, that time is when the piston 14 is on the suction stroke, i.e., the piston is moving to the left in FIGS. 1 and 2, and fluid is being drawn in through the inlet 24. At the same time, some fluid leaks past the piston rings and into the first-stage compression chamber 36, picking up heat from the inner walls and the piston rings in the process. When a cryogenic fluid is being pumped, this heat will cause some of the fluid being drawn into the compression chamber to boil. To minimize the effect of this heating cycle, the piston rings have been designed to be cooled by the discharge fluid during the compression stroke.

During the compression stroke, i.e., the piston 14 is moving to the right in FIGS. 1 and 2, and fluid is being discharged through the discharge 40 via the discharge valve 20, the pressure differential in the pump 10 is such that fluid flows from the higher pressure first-stage compression chamber 36 to the slightly lower pressure discharge. There is a slight pressure drop across the discharge valve as fluid flows through the discharge valve and out the discharge. This pressure drop, and the slight friction of the piston rings 28 against the inner walls 26 also allows this discharge fluid to pass around the piston rings and along the inner walls 26, thus cooling the inner walls of the housing.

The piston rings 28 are designed to seal in one direction only, which allows a significant amount of the cold discharge fluid to pass around the piston rings and across the inner walls 26 of the housing 12, removing heat generated on the suction stroke when the piston rings are forced against the inner walls by the large pressure differential. Because the fluid being pumped is liquid, there is little temperature rise during compression. The liquid being pumped is cold, and this cold fluid then passes around the piston rings during the discharge stroke, cooling the piston rings and inner walls and preventing the inner walls and piston rings from increasing temperature.

Since the pump 10 uses energy stored as pressure, there is no need for a flywheel. In the preferred embodiment, the cross-sectional area of the piston 14 is exactly twice that of the shaft 16. For the case where the maximum amount of power is required by the pump, which is the case where an incompressible fluid is being pumped, the pressure on the back side of the piston is always nearly equal to the discharge pressure. The pressure on the back side of the piston is not some lower interstage pressure when an incompressible fluid is being pumped. On the suction stroke, the amount of force is ½ the area of the piston times the difference in pressure across the piston. For the compression stroke, the amount of force is again ½ the area of the piston times the discharge pressure. For each case, the amount of load is roughly equal, resulting in the amount of energy required during each stroke to be roughly equal. The maximum amount of energy required by the pump for any given inlet pressure and discharge pressure is dictated by an incompressible fluid.

In operation, the following actions occur during the forward travel or stroke of the reciprocating piston 14 (i.e., toward the inlet 24):

1) The inlet valve 18 closes due to spring force on the inlet valve plus differential pressure across the inlet valve tending to close the inlet valve. The differential pressure is created as the volume in the first-stage compression chamber 36 decreases, increasing first stage pressure.
2) The fluid in the first-stage compression chamber 36 rises in pressure as the piston 14 moves toward the right. If gas exists, the increase in pressure will condense the gas into a liquid or a supercritical fluid (i.e., the fluid pressure increase is approximated by an isentropic process).

3) The fluid in the second-stage compression chamber 38 decreases in pressure as the piston 14 moves toward the right. Depending on the thermodynamic state of the fluid, some of the fluid may change state into a gas and expand as a gas (i.e., the fluid pressure decrease is approximated by an isentropic process).

4) When the pressure in the first-stage compression chamber 36 has increased above the pressure in the second-stage compression chamber 38, the interstage valve 22 will be forced open against its spring load. At the same time, the piston rings 28 will be forced off their respective seats by their spring load. Flow of fluid will occur though the interstage valve and also around each of the piston rings. The flow of fluid around the piston rings helps to remove heat generated by friction of the piston rings against the inner walls 26.

5) If and when the pressure in the second-stage compression chamber 38 has increased above the pressure on the outlet of the pump 10, the discharge valve 20 will be forced open against its spring load. Note that the total volume of the first and second stages decreases during the forward travel of the piston 14. This decrease in volume is equal to the cross sectional area of the shaft 16 times the length of stroke.

Given a perfectly incompressible fluid, step 3 above will not occur, and a volume of fluid equal to the total reduction in volume of the first and second stages (36 and 38) will be discharged through the discharge valve 20 during the forward travel or stroke of the piston 14.

In operation, the following actions occur during the rearward travel or stroke of the reciprocating piston 14 (i.e., away from the inlet 24):

1) The inlet valve 18 opens due to differential pressure across the inlet valve, compressing the valve spring 42. At the same time, the interstage valve 22 closes due to spring force on the interstage valve plus differential pressure across the interstage valve tending to close the interstage valve. The differential pressure is created as the volume in the first-stage compression chamber 36 increases, decreasing first stage pressure. During this rearward stroke, fluid is drawn into this first-stage compression chamber through the intake valve 18.

2) When the pressure in the second-stage compression chamber 38 has increased above the pressure on the outlet of the pump 10, the discharge valve 20 will be forced open against its spring load and fluid will be forced out of the pump.

The above description of the invention has focused on the preferred embodiment. However, persons skilled in the art will recognize that other embodiments and variations of the invention are possible. For example, although in the preferred embodiment, the shaft 16 has a cross-sectional area substantially equal to about ½ the cross-sectional area of the piston 14, that ratio of those cross-sectional areas may be varied.

In the preferred embodiment, the piston 14 is movable relative to the housing 12 and the housing has a fixed position. However, persons skilled in the art will recognize that the pump 12 may be designed so that the piston has a fixed position and the housing is movable relative to the piston.

Variations in the interstage valve means 22 also provide for alternate embodiments. In the preferred embodiment, the interstage valve means is a valve mounted on the piston 14, and the valve controls fluid flowing from the first-stage compression chamber 36 to the second-stage compression chamber 38. In an alternate embodiment, the interstage valve means is not mounted on the piston. In this case, there is an inlet port (not shown) in the inner wall 26 of the housing 12 adjacent the first-stage compression chamber, and a discharge port (not shown) in the inner wall of the housing adjacent the second-stage compression chamber. Transfer means (not shown), such as a conduit, transfers the fluid from the inlet port to the discharge port. The inlet port is in fluid communication with the first-stage compression chamber and the discharge port is in communication with the second-stage compression chamber.

The pump 10 uses a two-stage approach to compressing a single phase or a two phase cryogenic fluid. The way the pump handles this two stage design is unique. The pump uses a single housing 12 with a single piston 14 to create the two-stage affect. By combining the two stages into one housing, the overall design is much more simplified and cost effective than prior art pumps. It also reduces the amount of energy required during each half of the stroke, regardless of the condition of the fluid being pumped. This reduction in energy reduces the need for a flywheel or an oversized motor.

The two-stage design allows all of the fluid to pass through both stages when a pure liquid is being pumped. None of the fluid is returned to the tank or vented. Energy is stored during what is conventionally known as a suction stroke for use during a compression stroke.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. A reciprocating pump for pumping at least one fluid, comprising:

a housing having a longitudinal axis, at least one inner wall, a first end, a second end opposite the first end, an inlet adjacent the first end, a discharge between the second end and the inlet, and an open interior between the at least one inner wall and the first and second ends;

a piston slideably mounted within the housing for a reciprocating movement substantially parallel with the longitudinal axis, the piston having a first cross sectional area, a front end facing the first end, and a rear end opposite the front end, and dividing the open interior into a first chamber having a first volume adjacent the inlet and a second chamber having a second volume adjacent the discharge, the first and second volumes varying inversely with the reciprocating movement of the piston, wherein the first chamber is in controllable fluid communication with the inlet, the second chamber is in controllable fluid communication with the discharge, and the first and second chambers are in controllable fluid communication;

a shaft having a forward end connected to the rear end of the piston and a rearward end opposite the forward end, the shaft adapted for the reciprocating movement concurrently with the piston and at least part of the shaft disposed in the second chamber;

an inlet valve in communication with the inlet and adapted to control the fluid flowing through the inlet to the first chamber;

a discharge valve in communication with the discharge and adapted to control the fluid flowing from the second chamber through the discharge; and an interstage valve means in communication with the first chamber and the second chamber, the interstage valve means adapted to control the fluid flowing from the first chamber to the second chamber, wherein the interstage valve means is closed during a suction stroke and is open during a compression stroke, said suction stroke and said compression stroke occurring in an alternating manner during the reciprocating movement of the piston.

2. A reciprocating pump as in claim 1, wherein the part of the shaft disposed in the second chamber has a second cross sectional area substantially equal to about one half the first cross sectional area.

3. A reciprocating pump as in claim 1, wherein at least a portion of the fluid is a single phase fluid.

4. A reciprocating pump as in claim 1, wherein at least a portion of the fluid is a two phase fluid.

5. A reciprocating pump as in claim 1, wherein at least a portion of the fluid is a cryogenic fluid.

6. A reciprocating pump as in claim 1 further comprising sealing means adapted to provide at least one seal between the inner wall of the housing and an outer surface of the piston in an alternating manner during the reciprocating movement.

7. A reciprocating pump as in claim 6, wherein the seal is provided during the suction stroke.

8. A reciprocating pump as in claim 6, wherein the sealing means comprises at least one piston ring mounted peripherally on the piston.

9. A reciprocating pump as in claim 1, wherein at least part of the interstage valve means is mounted on the piston.

10. A reciprocating pump as in claim 1, wherein the interstage valve means comprises an inlet port in the inner wall adjacent the first chamber, a discharge port in the inner wall adjacent the second chamber, and transfer means adapted to transfer at least part of the fluid from the inlet port to the discharge port, the inlet port being in fluid communication with the first chamber and the discharge port being in fluid communication with the second chamber.

11. A reciprocating pump as in claim 1, wherein the piston is moveable relative to the housing and the housing has a fixed position.

12. A reciprocating pump as in claim 1, wherein the piston has a fixed position and the housing is movable relative to the piston.

13. A reciprocating pump for pumping at least one fluid, comprising:

a housing having a longitudinal axis, at least one inner wall, a first end, a second end opposite the first end, an inlet adjacent the first end, a discharge between the second end and the inlet, and an open interior between the at least one inner wall and the first and second ends;

a piston slideably mounted within the housing for a reciprocating movement substantially parallel with the longitudinal axis, the piston having a first cross sectional area, a front end facing the first end, and a rear end opposite the front end, and dividing the open interior into a first chamber having a first volume adjacent the inlet and a second chamber having a second volume adjacent the discharge, the first and second volumes varying inversely with the reciprocating movement of the piston, wherein the first chamber is in controllable fluid communication with the inlet, the second chamber is in controllable fluid communication with the discharge, and the first and second chambers are in controllable fluid communication;

a shaft having a forward end connected to the rear end of the piston and a rearward end opposite the forward end, the shaft adapted for the reciprocating movement concurrently with the piston and at least part of the shaft disposed in the second chamber;

means for controlling the fluid flowing through the inlet to the first chamber;

means for controlling the fluid flowing from the second chamber through the discharge; and control means for controlling the fluid flowing from the first chamber to the second chamber, wherein the control means is closed during a suction stroke and is open during a compression stroke, said suction stroke and said compression stroke occurring in an alternating manner during the reciprocating movement of the piston.

14. A reciprocating pump as in claim 13, wherein the part of the shaft disposed in the second chamber has a second cross sectional area substantially equal to about one half the first cross sectional area.

15. A reciprocating pump as in claim 13, wherein at least a portion of the fluid is a cryogenic fluid.

* * * * *